US007976688B2

(12) United States Patent
Demeulenaere et al.

(10) Patent No.: US 7,976,688 B2
(45) Date of Patent: Jul. 12, 2011

(54) METHOD FOR MAKING ANODES FOR ALUMINIUM PRODUCTION BY FUSED-SALT ELECTROLYSIS, RESULTING ANODES AND USE THEREOF

(75) Inventors: Ludovic Demeulenaere, Orchies (FR); Alain Van Acker, Beuvry la Foret (FR); Didier Lescarcelle, Lambres les Douai (FR)

(73) Assignee: E.C.L., Ronchin (FR)

( * ) Notice: Subject to any disclaimer, the term of this patent is extended or adjusted under 35 U.S.C. 154(b) by 304 days.

(21) Appl. No.: 12/297,227

(22) PCT Filed: May 10, 2007

(86) PCT No.: PCT/FR2007/000784

§ 371 (c)(1),
(2), (4) Date: Oct. 15, 2008

(87) PCT Pub. No.: WO2007/132081

PCT Pub. Date: Nov. 22, 2007

(65) Prior Publication Data

US 2009/0250355 A1 Oct. 8, 2009

(30) Foreign Application Priority Data

May 15, 2006 (FR) ..... 06 04286

(51) Int. Cl.
*C25B 11/12* (2006.01)
*C25B 11/02* (2006.01)
*C25B 11/04* (2006.01)

(52) U.S. Cl. ..... 204/294; 204/243.1; 204/247.3; 204/290.15; 205/384; 205/386; 205/387; 205/388; 29/746

(58) Field of Classification Search ..... 204/243.1, 204/247.3, 290.15, 294; 205/384, 386, 387, 205/388; 29/746
See application file for complete search history.

(56) References Cited

U.S. PATENT DOCUMENTS

| | | | | |
|---|---|---|---|---|
| 3,829,374 | A | 8/1974 | Kugler et al. | |
| 4,490,233 | A * | 12/1984 | Casdas | 156/62.2 |
| 4,569,835 | A | 2/1986 | Di Cio et al. | |
| 4,659,442 | A * | 4/1987 | Naterstad et al. | 205/389 |
| 5,096,631 | A | 3/1992 | Syversen | |
| 5,985,114 | A * | 11/1999 | Sekhar et al. | 204/290.02 |

* cited by examiner

*Primary Examiner* — Bruce F Bell
(74) *Attorney, Agent, or Firm* — Dennison, Schultz & MacDonald

(57) ABSTRACT

Method for manufacturing anodes used for the production of aluminium by fused bath electrolysis, said anodes comprising an anode stem made of a conducting metal and at least one block made of carbonaceous material called an anode block, said method including at least the following steps:

a) obtain an anode stem;

b) obtain a new anode block;

c) fix one end of the anode stem onto the anode block, so as to give good mechanical attachment and good electrical connection between said stem and said anode block;

said method being characterised in that before, during or after step c), but before placement of said anode in the electrolytic cell, a protective layer with a controlled thickness, typically between 5 and 25 cm composed of a material resistant to temperature and corrosion by the medium above the electrolytic bath is at least partially deposited on the upper surface of said anode block.

22 Claims, 3 Drawing Sheets

METHOD FOR MAKING ANODES FOR ALUMINIUM PRODUCTION BY FUSED-SALT ELECTROLYSIS, RESULTING ANODES AND USE THEREOF

FIELD OF THE INVENTION

The invention relates to a method for manufacturing anodes used for the production of aluminium by fused bath electrolysis, and more particularly manufacturing of pre-baked anodes used for aluminium production according to the Hall-Héroult process.

DESCRIPTION OF RELATED

Aluminium is produced industrially by fused bath electrolysis in electrolytic cells using the well-known Hall-Héroult process. French patent application FR 2 806 742 (corresponding to American U.S. Pat. No. 6,409,894) discloses installations in an aluminium smelter designed for aluminium production. The electrolytic bath is contained in electrolytic cells that include a steel pot shell coated on the inside with refractory and/or insulating materials and a cathode assembly at the bottom of the pot. Anodes, typically made of a carbonaceous material, are fixed to a superstructure provided with means that displace them vertically, said anodes being progressively consumed during the electrolysis process. The anodes are immersed in a liquid bath containing alumina and cryolite, a melting agent comprising essentially aluminium fluoride and sodium fluoride that enables the alumina thus mixed to melt at about 950° C. The assembly formed from an electrolytic pot, its anodes and the electrolytic bath is called an electrolytic cell.

The smelters contain a large number of electrolytic cells arranged in line, in buildings called electrolysis halls or rooms, and electrically connected in series using connection conductors. According to the most widespread technology, the electrolytic cells comprise a plurality of anodes including a metal stem and a block made of carbonaceous material called an anode block, which is consumed during electrolytic reduction reactions of aluminium.

In general, the smelters contain an anode preparation and handling shop and an anode rodding shop, in which the metal stem and block made of carbonaceous material are assembled. These shops are intended for recycling of stems and spent anode blocks called anode butts and for preparation of new anodes, for example from pre-baked carbonaceous blocks output from an anode baking shop.

During operation, a smelter requires work on electrolytic cells including particularly replacement of spent anodes by new anodes, sampling of the liquid metal, samplings or addition of electrolyte and deposition of a cover material that is a mix of alumina and "crushed bath" powders on and around the anodes, the "crushed bath" itself being a recovered, solidified, and then crushed electrolytic bath.

The purpose of this final operation called "anode coverage" is intended to reduce heat losses and to protect the emerged part of anodes from combustion by ambient air. It consists of covering the anode blocks and the spaces between them as uniformly as possible with the cover material. Typically, the cover material must cover the anode blocks with a thickness of about 10 cm. It is important to make a careful coverage of the anode blocks if it is required to efficiently limit carbon losses related to combustion. Typically, a loss of the order of 20 kg of carbon per tonne of aluminium produced is observed, but if said cover is badly distributed, the carbon loss can be as high as 50 kg per tonne of aluminium. Furthermore, it has been observed that poor anode coverage is correlated with the occurrence of deformed anode assemblies, or even broken connections between the stem and the anode block.

In the past, anode coverage was made manually or in an assisted manner using a device fixed on a carriage moving along a travelling crane passing above the pots, for example a pot tending assembly PTA that is also used to replace the anodes. For example, the international application WO2005/095676 issued by the applicant discloses a particularly compact pot tending assembly PTA that contains at least all tools necessary for replacement of anodes and a hopper intended for distribution of the cover material. In the manual version, at least one operator pours bags of cover material and spreads it with an appropriate tool. In the version in which the coverage operation is assisted by a PTA, this assembly comprises a hopper and a cover material distribution device composed mainly of a cranked tube capable of moving upwards, downwards and being moved to any location above the anodes, the mechanism being controlled by an onboard operator in a cab on the PTA or located on the ground close to the area to be covered, using a control box.

Regardless of the method used for this operation, a large disparity in the coverage quality is often deplored, aggravated in time because in the early days following placement of a new anode, it is difficult to keep a sufficiently thick coverage layer above the anode due to the shape of the upper part of the anode that has chamfered corners to facilitate removal and recovery of the solidified bath when the anode is extracted from the pot at the end of its life.

French patent application FR 2 527 229 discloses a thermal insulation method that consists of placing an aluminium strip around the periphery of the upper part of the anode, so as to create a barrier to maintain a sufficiently thick thermal insulation layer above the anode. Thus, as the anode wears and lowers, the aluminium strip arrives in increasingly hot zones and finally progressively melts. In the meantime, the crushed bath losses its fluidity and is sintered in a manner such that the layer remains in place above the anode and provides satisfactory thermal insulation. But such a method firstly requires that the shape of the anode is modified to receive and to retain the aluminium strip, and secondly remains tributary to manual or assisted mode used for coverage of the anodes.

Application WO89/10436 discloses a method in which the pins of the anode stem are surrounded by sleeves or collars. In some embodiments, these collars may be formed at the same time as the bottom of the stem is rodded in the carbonaceous block. They may be obtained by compression in a two-shell mould under pressure applied laterally and/or through the top. These collars that can cover the top of the anode block only very locally are intended essentially to protect the pins.

SUMMARY OF THE INVENTION

The Applicant has attempted firstly to improve control over the thermal insulation of anodes within the pot and secondly protection of said anodes against aggression from the hot and oxidising medium located above the electrolytic bath.

A first purpose of the invention is a method for manufacturing anodes used for production of aluminium by fused bath electrolysis, said anodes comprising an anode stem made of a conducting metal and at least one block made of carbonaceous material called an anode block, said method including at least the following steps:

a) obtain an anode stem;

b) obtain an appropriate number of anode blocks, to be fixed to the anode stem;

c) fix one end of the anode stem onto said anode block(s), so as to give good mechanical attachment and good electrical connection between said stem and said anode block(s).

As mentioned above, a stem may be associated with several anode blocks. In the following, we will sometimes use the term "anode block" in the singular to denote all blocks associated with an anode. Obviously, the anode blocks concerned by the invention are new anode blocks output from the anode block manufacturing shop and that have never previously been inserted into an electrolytic cell.

The process according to the invention is characterised in that before, during or after step c), but before placement of said anode in the electrolytic cell, a protective layer with a controlled thickness, typically between 5 and 25 cm composed of a material resistant to temperature and corrosion by the medium above the electrolytic bath, is at least partially deposited on the upper surface of said anode block. Said upper surface is the part of the anode block that remains emerged outside the electrolytic bath. It is usually located close to the connection with the metal stem, opposite to the part of the anode block facing the bottom of the pot that acts as the cathode. The material in said protection layer is advantageously refractory and chemically inert with regard to the electrolyte and gases circulating on the surface of said electrolyte.

Thus, unlike the method disclosed in FR 2 527 229, the method according to the invention covers the anodes outside the electrolytic cell, before their placement in said cell, with a layer of protective material with an easily controllable thickness that can be kept constant despite various manipulations made on said anode before it is placed in the pot and has reached a steady state of thermal equilibrium. Furthermore, this method does not require placement of an aluminium strip on the periphery of the upper part of the anode block.

Said protective layer may be deposited before, during or after assembly in step c). The sequence of operations depends essentially on the assembly type made and the nature of the material chosen for the protective coating. The stem and the anode block are usually assembled by rodding of one end of the stem that usually comprises several stands or "pins" into cavities formed on the anode block. If the deposited layer is extremely easy to remove locally (typically by machining, coring, etc.), it is advantageous to make the deposit before making said cavity(ies) on the part of the surface of the anode block in which the end or pins of the anode will fit. On the other hand, if the coating material is particularly hard to remove, it is preferable to make the deposit after assembly, even if access conditions are limited due to the presence of the stand of the anode stem and consequently a slightly less homogeneous material is obtained, particularly when the protective layer has to be made by compaction of a powdery material.

This method that concerns all combined anodes resulting from the assembly of a metal stem and a carbonaceous block, is particularly advantageous when it is applicable to manufacturing of so-called "pre-baked" anodes. The stem of a pre-baked anode, made of a conducting metal, associated with a device for fixing it onto the superstructure and with an electrical connection device, has a rectangular section. The anode block of a pre-baked anode is substantially parallelepipedic in shape and the stem is fixed onto one face of said anode block, typically the face opposite the face that will be facing the bottom of the pot that forms the cathode assembly.

The connection between the stem and the anode block of a pre-baked anode is made through a stand, typically made of steel, fixed to the base of the stem, and that is usually in the form of an upside down lamppost, each branch of the lamppost being associated with a cylindrical end, the axis of which is parallel to the stem and that is called "pin". The stem and the anode block are assembled by means of a "rodding" operation in which the pins are inserted inside recesses made on the upper face of the carbonaceous block and in which the interstices existing between the pins and the reamings are filled by pouring a molten metal, typically cast iron. The metal bushings thus made, also called "drums", give a good mechanical bond and good electrical connection between the stem and the block made of a carbonaceous material. A stem is sometimes associated with several anode blocks.

Conventionally, the pre-baked anode is presented with a metal anode stem rising vertically above the upper face of the anode block. This upper face has a substantially larger surface than the section of the stem; when the stem is fixed on the anode block, the cross section of the anode block orthogonal to the direction of the stem is substantially larger than the orthogonal section of said stem, typically more than 10 times the section of said stem. This large face has to be protected, preferably on its largest part, by depositing a substantially solid, in other words a solid or highly viscous, protective coating with sufficient consistency so that it can remain on the anode without disintegrating during anode manipulations before the anode is put into place in the electrolytic cell.

According to the invention, the protective layer is deposited typically with a substantially constant thickness over most of the upper face of the anode block. Preferably, if the entire part of said upper face cannot be covered, for example due to the presence of the anode stand and the resulting size, a coating is made comprising at least a substantially solid annular zone located approximately around the periphery of the upper face of the anode block. In this way, parts not covered by the solid annular coating form cavities that may for example be filled with a powdery cover material that can be held in place by said coating during various anode manipulations.

With the method according to the invention, the thickness of the protective layer that also acts as thermal insulation can be controlled; the anodes used may have a variable thickness layer controlled and verified in the anode manufacturing shop that depends on the required thermal conditions. The thickness is typically between 5 and 25 cm depending on the material used.

Preferably, the material of the protective layer has some chemical components such as aluminium oxide and aluminium fluoride that are similar to components in the cover material used in the past. Also preferably, so as to not excessively disturb the electrolytic bath (its acidity and reactivity, etc.), this material also comprises other bath components such as sodium fluoride and possibly other additives also present in the cryolite such as calcium fluoride. In this way, the anodes thus obtained are firstly covered by a protective layer, the thickness of which is controlled at all locations of the upper part of the anode block and that does not present any risk of pollution of the electrolytic bath.

The following sequence of steps could be envisaged to make the deposition:

a) a peripheral wall is arranged on the upper part of said anode block, such that it forms a mould with the upper surface of said anode block, b) a fluid material is poured into the mould thus formed;

c) a treatment is applied to said fluid material to obtain a solid layer fixed to said anode block;

d) said peripheral wall is removed.

A peripheral wall is arranged on the upper part of the anode assembly such that it forms a mould with the upper surface of the anode block(s) associated with the anode assembly, the mould being designed to retain a fluid material based on products with a chemical composition preferably similar to the composition of materials making up the cover material used in the conventional anode coverage method inside electrolytic cells, namely alumina and cryolite constituents.

Said fluid material may be in several forms:

- a dry powdery form, for example mix of alumina and crushed bath powders used at the moment;
- a pasty form, the mix having firstly been mixed with a binder that is then made to disappear by evaporation, fusion or decomposition.

These two forms are characterised by the use of a fluid material comprising solid particles. After an appropriate treatment, a solid layer is obtained comprising said agglomerated solid particles and that is fixed to the anode thus covered.

Advantageously, this fluid material may be made starting from the powdery cover material that is used at the moment and that is a mix of alumina and crushed bath powders, which is itself obtained from a cryolite and alumina mix.

But the fluid material can also be in liquid form after having been firstly heated, possibly mixed with a melting agent, and in the molten state for pouring.

The mould quality, in other words conditions for placing the peripheral wall on the upper part of the anode block, depends on the fluidity of the fluid material that is used; a liquid material requires a better seal in contact with the anode block than a pasty material. If necessary, in the case of a particularly liquid material, it would be possible to modify the shape of the upper part of the anode by making a peripheral rim appear during moulding of the carbonaceous part on which said peripheral wall bears, or a groove into which the wall fits. But such a modification of the shape of the anode is not necessary for most fluid materials considered in the context of this invention, particularly those containing solid particles.

The wall can be designed to facilitate manipulations, to resist shocks during placement on the anode block, to not damage the anode block and to resist mechanical and/or heat treatments applied to transform the fluid material into a solid layer. Obviously, if the fluid material is a molten mix containing aluminium oxide and aluminium and sodium fluorides, the material in the transverse wall must be capable of resisting high temperatures, typically higher than 1000° C.

For example, the mould could be made by providing a set of folded plates connected to each other with a shoulder that surrounds and bears on the peripheral edge of the anode block(s) in the anode assembly, such that said plates form a chamber surrounding the upper surface of the anode block(s) that thus form the "bottom" of the mould. In the case in which the anode assembly comprises several anode blocks separated by an interstice, it would be possible for a wall to be placed around the periphery adjacent to said interstice and that typically drops a few centimeters below the upper face, so as to prevent or at least slow the flow of fluid material through said interstice, the height of the lateral coverage of said interstice being defined as a function of the air gap in the interstice and the viscosity of the fluid material.

As mentioned above, several treatments are possible in order to obtain a solid layer from the fluid material. However, these treatments depend on the nature of the fluid material used.

If said fluid material is used in a dry powder form, for example the mix of alumina and crushed bath powders used at the moment, the powder is collected in the mould, its surface is equalised (typically using a scraper), so as to obtain an approximately uniform height in the mould, and it is then compacted, typically by application to a hydraulic press using at least one punch for which the external contour typically matches the contour of the mould, and then heated to the sintering temperature to obtain a solid agglomerated layer. Obviously, in this case, said peripheral wall must be capable of resisting high compaction forces and a simple assembly of folded plates may not be sufficient. Advantageously, this assembly of plates can be replaced by a set of vertical plates activated by jacks and arranged such that at the end of travel of the jacks, they are located close to or even slightly bearing in contact with the vertical peripheral faces of the anode block, and together form said peripheral wall.

If said fluid material is used in paste form, the mix was previously mixed with a binder, typically water, a resin, a wax or a geopolymer, and the binder is then made to disappear by evaporation, fusion or decomposition. Water in particular forms an excellent binder if it is mixed with the cover material to make said fluid material. In general, said binder is made to disappear before the anode assembly is introduced into the electrolytic cell. However, some binders such as waxes that are solid at ambient temperature may be used to transport the highly viscous layer deposited on the anode assembly, in its existing condition. In this case, they can only be made to disappear after the anode is placed in the electrolytic cell under the effect of the temperature inside the cell. Obviously, the first step is to verify that such a disappearance does not significantly pollute the inside of said cell.

If said fluid material is used in the form of a molten bath, cooling is done to obtain a sufficiently solid and rigid layer so that the anode thus covered can be easily transported.

Once this treatment has been terminated, said peripheral wall can be removed and an anode thus covered by a solid coverage layer at least 5 cm and preferably more than 10 cm thick over the entire upper surface of the anode blocks is exposed. This layer is not necessarily very strong mechanically but it must have sufficient cohesion to remain fixed to the anode without necessarily strongly bonding to the surface of the anode block, and it must be held intact on the upper part of the anode block during transport of the anode block to the electrolytic cell and manipulations during its placement.

Once the anode has been put into place in the cell, spaces between the new anode and neighbouring anodes still need to be covered. This action also requires a manual or semi-automatic operation under the visual control of an operator. But the work is faster, is less disturbing to operation of the cell and the risk of a poor distribution of the coverage is lower. However, in one preferred embodiment of this invention, a cover is made such that the work done by an operator to cover spaces between the new anode and adjacent anodes can be eliminated. A mould with a special shape is made that can give a spare cover material to cover the spaces between the anode assembly and adjacent anode assemblies positioned in the pot. The shape of the mould is designed such that its external perimeter at least partially comprises an excrescence that can be used to make a cornice overhanging the sidewall of the anode block, the volume of which corresponds to the volume of the cover material necessary to fill said spaces between anode blocks. Said cornice is preferably placed at least in the locations that are least easily accessible when the anode is installed in the cell, namely close to the side of the anode block that will be positioned close to the longitudinal median axis of the cell.

The covered anode thus obtained has a "cornice" around its periphery composed of a protective material, for example a material similar to an agglomerated or sintered crushed bath. Once the anode has been put into place in the electrolytic cell, a destructive treatment is applied to said cornice that has the effect of disintegrating the portion of the overhanging cornice, allowing the disintegrated particles to fall and thus fill the space between said anode block and adjacent anode blocks.

A first treatment consists of using ultrasounds that destroy the material from which the cornices are made, making it change to the powder state such that the powdery debris of the cornice fill spaces between the anode blocks as they fall.

A second treatment consists of filling the excrescence with a mix based on the cover material and a binder that is destroyed at a temperature greater than 60° C. Once the anode has been put into place in the cell, the cornice quickly reaches a temperature of more than 60°, the binder melts and the mix pours, naturally filling spaces between the anode blocks. Some resins or waxes can be used:

- beeswax (cerotic acid, myricilpalmitic ether), that has a melting temperature between 62 and 70° C. (usually 63 or 64° C.);
- carnauba wax or Brazil wax, for which the chemical constituent is myricil ceronate and that melts at between 82 and 86° C.;
- Coromandel lacquer gum wax, that has a melting point very similar to the carnauba wax;
- Chinese vegetable waxes that are secreted by trees in reaction to a sting by a parasite, the coccus. Their melting temperature is 82° C.;
- finally, in some cases water can be tried, that changes to the gas state at 100° C.

The material in the part of the layer covering the anode block and the material of the cornice must satisfy different and hardly compatible requirements; the anode cover material must remain stable with time so as to efficiently protect the immerged part of the anode, but the cornices must disintegrate not more than a few hours after the anode block is placed in the cell. Advantageously, the peripheral wall is designed for example by providing it with baffles or transverse walls, such that the layer immediately above the anode block and the cornice are made by means of different fluid materials.

More generally, the method can be broken down into several steps:

- either a first step to deposit a protective layer and then an assembly step, typically by bonding, using cornices manufactured separately from a friable material.
- or several deposition steps so as to obtain a multi-material coating. For example, several layers of different materials can be stacked, the surface of a previously deposited layer acting as the bottom for the new mould thus formed. In each step, the same peripheral wall or another wall with a different shape is used. Thus, a first layer of agglomerated material with a satisfactory mechanical strength can be deposited using a first mould without excrescences, and then a second layer with a material easy to disintegrate with a second mould capable of forming cornices overhanging the vertical walls of the anode block. A first layer can also be deposited using a first mould with a vertical wall or a wall with a significant taper making it wider at the bottom, and once the first layer has been deposited, an oblique peripheral wall with a taper making it narrower at the bottom, to make a mould that will form an annular cornice, using at least this oblique peripheral wall and the lateral edge of the first layer.

Another purpose of the invention is an anode assembly comprising a metal stem and at least one anode block characterised in that the upper surface of said anode block is at least covered partially by a layer typically between 5 and 15 cm thick of a material resistant to temperature and corrosion by the medium above the electrolytic bath. The material from which said protective layer is made is advantageously refractory and is chemically inert with regard to the electrolyte and gases circulating on the surface of said electrolyte.

Advantageously, this anode assembly is a pre-baked anode and the protective layer at least partially covers the upper face of the anode block, forming at least a solid annular layer located approximately at the periphery of said upper face. Preferably, the material from which the protective layer is made has some chemical components such as aluminium oxide and aluminium fluoride that are similar to components in the cover material used up to now. Also preferably, this material also comprises other bath components such as sodium fluoride and possibly other additives also present in the cryolite such as calcium fluoride, so as to not excessively disturb the electrolytic bath (its acidity, its reactivity, etc.).

Preferably, the protective layer comprises solid alumina and crushed bath particles. Advantageously, said layer at least partially has a cornice overhanging the lateral wall around the periphery of said anode block, the volume of which corresponds to the volume of the cover material necessary for filling in spaces between anode blocks.

Another purpose of the invention is the use of an anode assembly as described above, within the framework of the Hall-Héroult process for producing aluminium by fused bath electrolysis.

DESCRIPTION OF A PREFERRED EMBODIMENT

The example described below is based on a particular geometry shown in FIG. 1, of a conventional pre-baked anode. Obviously, the method according to the invention can be applied to all other known pre-baked anode geometries.

Figure 1:
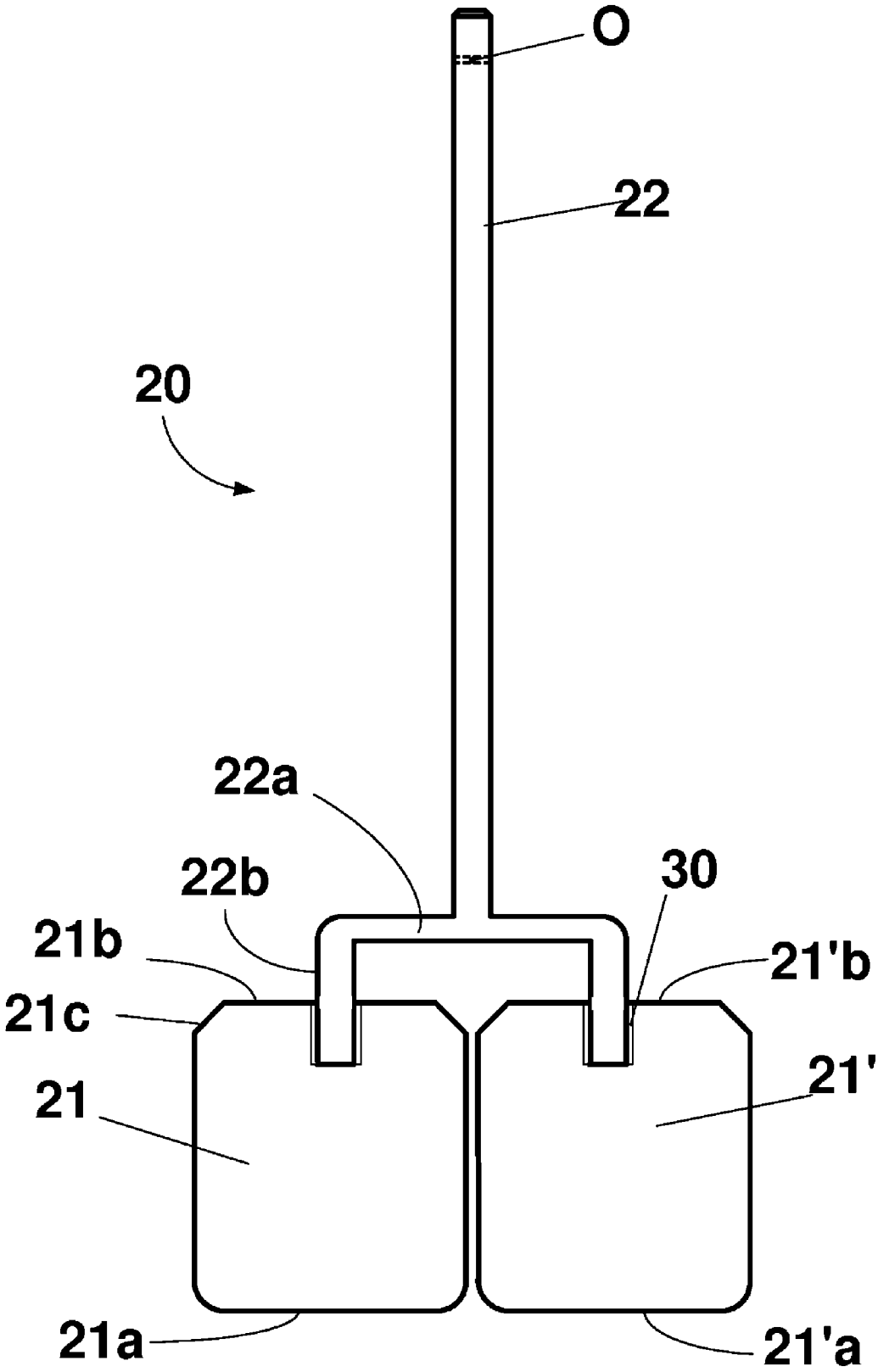
FIG. 1 diagrammatically shows a typical pre-baked conventional anode.

The anode 20 in FIG. 1 comprises a metal stem 22 associated with two new anode blocks 21 and 21' made of a carbonaceous material. The stem 22 with a rectangular section is associated with a device for fixing it onto the superstructure and an electrical connection device (not shown). The anode blocks 21 and 21' are parallelepipedic in shape and the stem 22 is fixed onto a face (21*b*, 21'*b*) of each of said anode blocks opposite the face (21*a*, 21'*a*) that will be put facing the bottom of the pot that forms part of the cathode assembly.

The connection between the stem and the anode blocks is made through a stand fixed to the bottom of the stem, shaped like an upside down lamppost with six branches (22*a*) at the ends of which pins (22*b*) are placed in groups of three, each group of pins being designed to be fixed to an anode block. During rodding, the pins are inserted inside recesses formed on the upper face of the anode blocks 21 and 21' and the interstices existing between the pins and the reamings are filled by pouring in cast iron. The metal bushings 30 thus made assure a good mechanical bond and a good electrical connection between the stem 22 and the blocks 21 and 21'.

The upper face (21*b*, 21'*b*) of the anode blocks has a surface substantially larger than the cross section of the stem 22. The upper face has a peripheral chamfer 21*c*, for reasons related to anode block manufacturing conditions. This geometric configuration is not conducive to maintaining a regular thick layer of the cover material after placement of the anode in the cell. This large face bordered by a peripheral chamfer is to be covered by a protective layer in the framework of this invention.

In the following examples, the deposition is made on the upper face of the anode blocks after rodding, in other words after having assembled the stem and the anode blocks.

Example 1

Figure 2A:
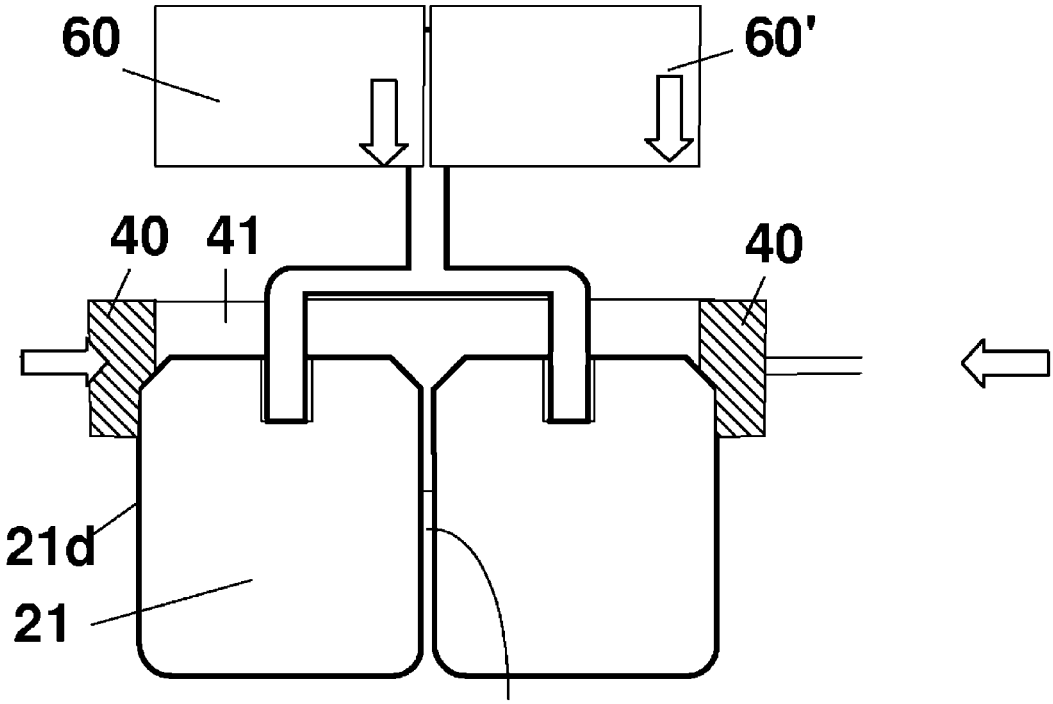
FIGS. 2*a* and 2*b* diagrammatically show two steps in a particular embodiment of the invention based on the geometry of the particular example of the anode shown in FIG. 1.
Figure 2B:
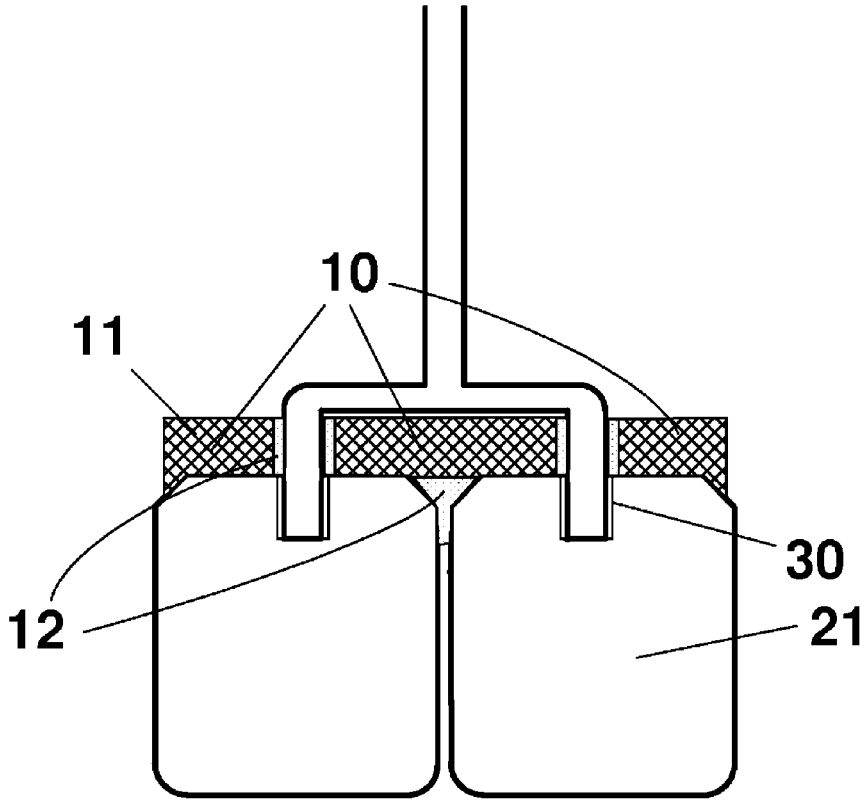
Figure 3A:
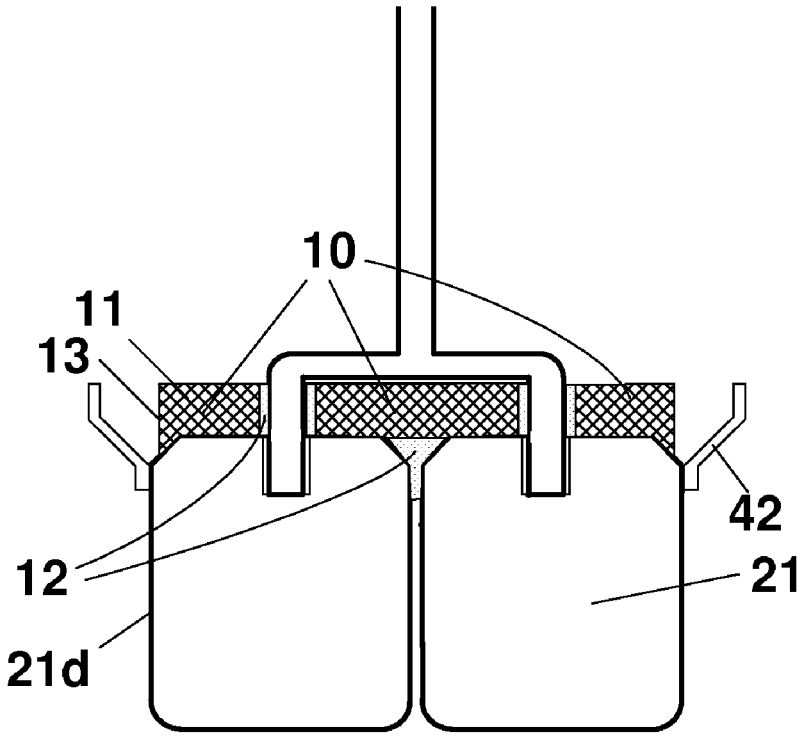
FIGS. 3*a* and 3*b* diagrammatically show two additional later steps in a variant of this particular embodiment of the invention. In this variant, after the first layer has been made, a mould is formed with the lateral edge of the first layer, part of the upper face of the anode blocks and an oblique peripheral wall, such that a cornice can be made overhanging the lateral wall of the anode blocks.
Figure 3B:
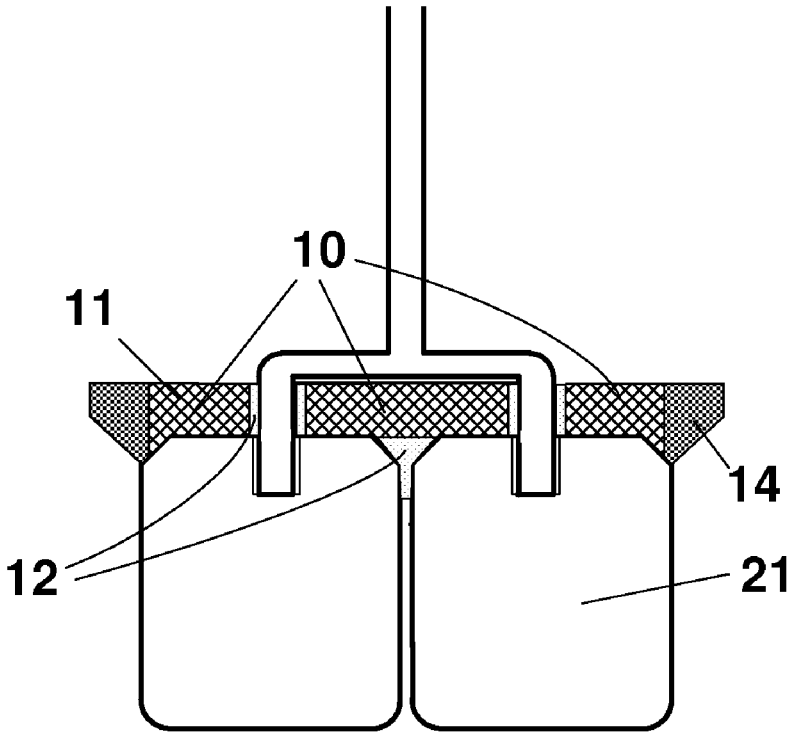

FIGS. 2*a* and 2*b*

Four vertical plates (2 reference 40 and one reference 41 in FIG. 2*a*) are arranged around the periphery of the upper faces 21*b* and 21'*b* of anode blocks 21 and 21', actuated by jacks (not shown) along a substantially horizontal direction. These plates are arranged such that at the end of the travel distance of the jacks, they are bearing slightly in contact with the four vertical peripheral faces 21*d* of the assembly of anode blocks. Together they form said peripheral wall that cooperates with the upper faces 21*b* and 21'*b* of the anode blocks to delimit the space in which the cover material will be compacted.

The fluid material of the cover material is a mix of alumina and "crushed bath" powders, this crushed bath itself being a recovered, solidified and then crushed electrolytic bath. The powder mix is introduced into the mould thus formed. The interval 23 between the blocks 21 and 21' is sufficiently thin to prevent a large loss of cover material. To minimise losses, the height of at least the plates 41 adjacent to the interstice 23 is such that they drop a few centimeters below the upper face 21*b*+21'*b*, the lateral overlap height of said interstice being defined as a function of the air gap of this interstice and the viscosity of the fluid product.

The cover material powder is collected in the mould, its surface is made uniform so as to obtain an approximately uniform height in the mould. It is then compacted by vertical action of two punches 60 and 60', each being located vertically in line with an anode block. Each punch has recesses towards the inside of the assembly, derived from the arm shapes at the bottom of the stem such that said punches can drop freely towards the anode blocks without coming into contact with said arms at the bottom of the stem. The outer contour of the punches is designed such that it is set back slightly from the wall formed by the assembly of plates 40.

In this example, the accumulated surface of the upper faces 21*b* and 21'*b* of the anode blocks 21 and 21' is of the order of 2 $m^2$. The fluid material, in fact a mix of alumina and "crushed bath" powders is compacted by using a jack capable of supplying a force of 300 tonnes. The side plates, designed to form protective layers not more than 20 cm thick, are actuated by jacks capable of resisting reaction forces of 60 tonnes.

After compaction, the plates are removed and the assembly is heated to the sintering temperature, typically between 500° C. and 600° C., to obtain a solid agglomerated layer. Admittedly, due to the presence of the side branches at the bottom of the stem, part of the powder, particularly close to the recesses, has been only slightly or badly compacted. But, since the punches completely surround the upper faces 21*b* and 21'*b* of the anode blocks 21 and 21', a coating 10 is made in which at least the annular zone 11 located substantially around the periphery of said upper face, is solid because it is located directly under the punches and was satisfactorily compacted. The zones 12 in which the powder cover material is more or less well agglomerated, particularly the zones in the vicinity of the pins 22*b*, are surrounded by said annular zone 11. In this way, the cover material, even badly or slightly agglomerated, is held in place during the various anode manipulations. At worst, if it is removed during the manipulations, cavities are formed in these zones that can be filled with the cover material once the anode is installed in the cell.

Example 2

FIGS. 2*a*, 2*b*, 3*a* and 3*b*

In this example, the initial steps are the same as in the above example, to form a protective layer on the upper faces 21*b* and 21'*b* of the anode blocks 21 and 21', but manufacturing is continued by making cornices overhanging the external vertical walls 21*d* of the anode blocks.

The first layer was made such that its peripheral edge 13 is slightly set back from the vertical wall 21*d* of the anode blocks. An oblique peripheral wall 42 is constructed tapered to be narrower at the bottom, so that combination of this wall, the lateral edge of the first layer 13 and part of the chamfer 21*c* of the upper face 21*b* of the block, creates a mould designed to form an annular cornice 14.

A mix is prepared comprising the cover material and a binder, the binder representing 5 to 15% by weight of the mix and it is poured in the mould thus formed.

This binder may be a molten wax that is then allowed to cool in the mould. In this case, compaction and sintering of the first layer are done before the cornice is moulded.

The binder may also be water. In this case, moulding is done advantageously between compaction and sintering, such that the sintering treatment is also used to make the water in the cornice material evaporate. Since water is an efficient binder of the cover material, in this case the cornices must be disintegrated by means of ultrasounds.

The invention claimed is:

1. Method for manufacturing anodes used for the production of aluminum by fused bath electrolysis, the anodes comprising an anode stem made of a conducting metal and at least one anode block made of carbonaceous material, comprising the steps of:

a) obtaining an anode stem;

b) obtaining at least one anode block having an upper surface, and constructed and arranged to be fixed to the anode stem, the at least one anode block having never previously been inserted into an electrolytic cell;

c) fixing one end of the anode stem onto the at least one anode block, so as to provide good mechanical attachment and good electrical connection between said stem and said at least one anode block; and d) before, during or after said fixing, and before placement of said anode in the electrolytic cell, depositing onto at least a portion of the upper surface of the at least one anode block, a protective layer of controlled thickness between 5 and 25 cm, the protective layer comprising a material resistant to temperature and corrosion by a medium above the electrolytic bath, and forming thereby a substantially solid protective coating comprising a solid annular zone peripherally around the upper surface of the at least one anode block.

2. Manufacturing method according to claim 1, wherein the protective layer comprises a refractory material.

3. Manufacturing method according to claim 1, wherein the protective layer comprises aluminum oxide, aluminum fluoride and optionally at least one of sodium fluoride and calcium fluoride.

4. Manufacturing method according to claim 1, wherein said protective layer is deposited by the steps of:

a) arranging a peripheral wall on an upper part of said at least one anode block, such that the wall forms a mold with the upper surface of said anode block, b) pouring a fluid material into the mold thus formed;

c) applying a treatment to said poured fluid material to obtain a solid layer fixed to said at least one anode block; and d) removing said peripheral wall.

5. Manufacturing method according to claim 4, wherein said fluid material comprises a mixture of solid particles.

6. Manufacturing method according to claim 5, wherein said fluid material is a mixture of alumina and crushed bath powders.

7. Manufacturing method according to claim 4, wherein the peripheral wall has a shape such that the peripheral wall bears on the peripheral edge of the at least one anode block in an anode assembly, such that the wall forms a chamber surrounding the upper surface of the at least one anode block that thus form a bottom of the mold.

8. Manufacturing method according to claim 4, wherein the peripheral wall is provided with a shoulder that surrounds and bears on a peripheral edge of the at least one anode block.

9. Manufacturing method according to claim 4, wherein said fluid material is used in a dry powder form, said material is collected in the mold, the upper surface is equalized so as to obtain an approximately uniform height in the mold, said material is compacted using at least one punch and then at least a volume occupied by the mold is heated to obtain a solid agglomerated layer.

10. Manufacturing method according to claim 9, wherein said peripheral wall is made using a set of vertical plates actuated by jacks and is arranged such that at an end of a travel distance of said jacks, the jacks are close to or bearing slightly in contact with vertical peripheral faces of the at least one anode block, and together form said peripheral wall.

11. Manufacturing method according to claim 4, wherein said fluid material is in a pasty form, the fluid material comprising a binder which is water, a resin, a wax or a geopolymer, and the binder is subsequently removed by evaporation, fusion or decomposition.

12. Manufacturing method according to claim 4, wherein said fluid material is used in the form of a molten bath, and cooling is done to obtain a solid layer.

13. Manufacturing method according to claim 4, wherein a mold is formed having a shape such that an external perimeter of the mold at least partially comprises an excrescence capable of forming a cornice overhanging the sidewall of the anode block, the volume of said excrescence corresponding to the volume of a cover material necessary to fill spaces between anode blocks.

14. Manufacturing method according to claim 4, wherein the steps of depositing the deposition layer are performed a plurality of times, so as to obtain a multi-layer deposition, where a surface of a previously deposited layer acts as a bottom for a new mold for which, in each step, either the same peripheral wall as in the previous step or another wall with a different shape is used.

15. Manufacturing method according to claim 4, wherein a first layer is deposited using a first mold with a vertical wall or a wall with a significant taper becoming wider at the bottom, and once the first layer has been deposited, an oblique peripheral wall becoming narrower at the bottom, to make a mold that will form an annular cornice, using at least said oblique peripheral wall and the lateral edge of said first layer.

16. Anode assembly comprising a metal stem and at least one anode block that has never previously been inserted into an electrolytic cell, wherein the anode block has an upper surface that is covered by a layer between 5 and 15 cm thick, made of a material resistant to temperature and corrosion by the medium above the electrolytic bath, said layer comprising at least a substantially solid annular zone located approximately at a periphery of the upper surface.

17. Anode assembly according to claim 16, wherein the protective layer comprises aluminum oxide and aluminum fluoride, and optionally at least one of sodium fluoride and calcium fluoride.

18. Anode assembly according to claim 16, wherein said layer at least partially has a cornice overhanging from a lateral wall around the periphery of said anode block, the volume of which corresponds to the volume of cover material necessary for filling in spaces between anode blocks when they are installed in an electrolytic cell.

19. Method for producing aluminum by fused bath electrolysis according to the Hall-Héroult process, comprising using an anode assembly according to claim 16.

20. Method according to claim 19, wherein the layer at least partially has a cornice overhanging from a lateral wall around the periphery of said anode block, the volume of which corresponds to the volume of the cover material necessary for filling in spaces between anode blocks when they are installed in the electrolytic cell, and wherein a destructive treatment is applied to said overhanging cornice after replacement of a spent anode by a new anode, having the effect of filling a space between anode blocks.

21. Method according to claim 20, wherein said destructive treatment comprises using ultrasound to destroy material from which the cornices are made, changing the material to a powder state, such that the powdery debris of the cornice fill spaces between the anode blocks.

22. Method according to claim 20, wherein the cornice is formed from an excrescence and is filled with a mix based on a cover material and a binder that becomes fluid or is destroyed at a temperature greater than 60° C.

* * * * *